US008096593B2

(12) United States Patent
Gibbons

(10) Patent No.: US 8,096,593 B2
(45) Date of Patent: Jan. 17, 2012

(54) LATCH FOR SLIDING DOOR OR FRAME

(76) Inventor: Cindy Lou Gibbons, Aurora, OR (US)

( * ) Notice: Subject to any disclaimer, the term of this patent is extended or adjusted under 35 U.S.C. 154(b) by 394 days.

(21) Appl. No.: 12/390,985

(22) Filed: Feb. 23, 2009

(65) Prior Publication Data

US 2009/0212578 A1 Aug. 27, 2009

Related U.S. Application Data

(60) Provisional application No. 61/031,667, filed on Feb. 26, 2008.

(51) Int. Cl.
*E05C 19/06* (2006.01)
*E05C 17/04* (2006.01)

(52) U.S. Cl. ..... 292/262; 292/80; 292/87; 292/DIG. 15; 292/DIG. 46

(58) Field of Classification Search ..... 292/80, 292/81, 87, 89, 262, 267, DIG. 15, DIG. 46
See application file for complete search history.

(56) References Cited

U.S. PATENT DOCUMENTS 278,802 A * 6/1883 Kubler ..... 292/87
3,397,001 A * 8/1968 Friedman ..... 292/87
4,030,246 A 6/1977 Naylor
4,139,249 A * 2/1979 Hillman ..... 312/333
4,248,461 A * 2/1981 Stevens ..... 292/218
4,621,846 A * 11/1986 Lefor ..... 292/152
4,631,776 A * 12/1986 King ..... 16/82
4,688,023 A * 8/1987 McGill et al. ..... 340/545.6
5,203,596 A * 4/1993 Stevens ..... 292/204
5,795,044 A * 8/1998 Trewhella et al. ..... 312/333
6,382,689 B1 * 5/2002 Brown ..... 292/338
7,261,329 B1 * 8/2007 Julian et al. ..... 292/84
7,452,011 B1 * 11/2008 Lind ..... 292/87
7,731,252 B1 * 6/2010 Stewart ..... 292/259 R

OTHER PUBLICATIONS

Goossens, D.P., "Is Your Horse Stall Safe?", InfoHorse.com (http://infohorse.com/safehorsestall.asp), visited Dec. 27, 2007, Copyright 2007, 3 pgs.

* cited by examiner

*Primary Examiner* — Carlos Lugo
(74) *Attorney, Agent, or Firm* — Ganz Law, PC

(57) ABSTRACT

A latch for a sliding frame may be provided with a mounting end for mounting the latch on a mounting surface over which a sliding frame would travel along a sliding path, and a resilient blocking element having an end portion and a body portion coupled to the mounting end, and a stop element positioned to engage the end portion of the resilient blocking element and adapted to prevent the sliding frame from opening when the frame is in a closed position. A user may disengage the latch by removing the resilient blocking element from the sliding path so that the sliding frame can be moved to an open position.

15 Claims, 9 Drawing Sheets

LATCH FOR SLIDING DOOR OR FRAME

RELATED APPLICATIONS

This application claims priority from U.S. Provisional Application No. 61/031,667, filed Feb. 26, 2008, the contents of which are hereby incorporated by reference as if recited in full herein for all purposes.

BACKGROUND

The inventive subject matter disclosed herein is directed to a latch or locking mechanism for a sliding door or frame, such as used as barn stall doors, closet doors, pocket doors, or window frames, for example.

Sliding doors or window frames generally have a panel with an inside and outside face. Typically, the panel slides open over an adjacent parallel surface. For some sliding doors, such as closet doors, the adjacent surface is often formed by another sliding door.

Sliding doors may be provided with a sliding arrangement, for example in the form of a track and wheel, to secure the door to a support and allow for opening and closing the door with a sliding movement. The doors may be fitted to a surrounding frame allowing the rolling or sliding motion at the top and/or the bottom of the track.

Sliding doors are often used as barn stall doors, either indoor or outdoor. They can be either single or double sliding doors. To prevent animals from opening stall doors, latches are often needed. Certain animals, such as horses, are especially creative in tampering with doors. The types of latches used in a specific system depend largely on the sliding door manufacturer and the material used for the construction. Latches for a door or a gate, typically consist of a bar that fits into a notch or slot and is lifted from either side by a lever or string. Latches range in complexity from flexible, one-piece flat springs of metal or plastic, to multi-point cammed latches used to keep large doors closed. Traditional stall door latches can be a hazard, as people often forget to pull the door latch completely back. This condition may skin and injure the side of the animal as it exits the stall door. In other cases, animals may kick the sliding door repeatedly until it opens, leading to door damage and the animal escaping the stall. Door maintenance can be time consuming, aggravating, and expensive over the life of a barn.

Accordingly, there is a need for a latch that minimizes catch points that can injure an animal and that securely locks the sliding door.

Similar sliding or bypass doors are often used for closets. These doors typically have two or more interacting sliding doors. Bypass doors are usually hung from a track, which is installed below the head jam of the door opening. The track is usually hidden by a piece of decorative trim. Often it may be desirable to restrict access to the closet, for example, to prevent children from opening the closet.

Accordingly, there is a need for a latch that provides a safe and secure locking mechanism to a sliding door or window frame.

In all cases, there is a need for latches that are easy to install, use, and maintain.

SUMMARY

The inventive subject matter offers a solution for these problems by providing a latch with the following qualities, alone or in combination.

The inventive subject matter is directed to a latch for locking a sliding door or frame. In one possible embodiment, a latch for a sliding frame may have a mounting end for mounting the latch on a mounting surface over which a sliding frame would travel along a sliding path, a resilient blocking element having an end portion and a body portion coupled to the mounting end, and a stop element positioned to engage the end portion of the resilient blocking element and adapted to prevent the sliding frame from opening when the frame is in a closed position. The resilient blocking element allows a user to disengage the latch by removing the resilient blocking element from the sliding path so that the sliding frame can be moved to an open position. In the foregoing embodiment, the stop element may be a separate element mounted on a surface of the sliding frame or mounted on the mounted surface. In the foregoing embodiment, the stop element may be integrated with the resilient blocking element to engage the sliding frame. In the foregoing embodiment, the resilient blocking element may be movable to a position between the mounting surface and the sliding path so that a user can disengage the latch by pressing the resilient blocking element into the space between the mounting surface and the sliding path. In the foregoing embodiment, the resilient blocking element may be positioned at an angle relative to the mounting end to cover the space between the mounting surface and the sliding door.

In another possible embodiment, the stop element is adapted to interact with the resilient blocking element, and the resilient blocking element being movable to a position away from the stop element by a user pulling the resilient blocking element over the stop element thereby allowing the frame to follow a sliding path over the stop element to an open position, and the resilient blocking element returning to the frame blocking position when the frame closes.

In one possible embodiment, the latch may further include a mounting element coupled to the mounting end, and adapted to couple the mounting end to a mounting surface, for example, by a tensioned fit to a mounting surface. In the foregoing embodiment, the resilient blocking element may include a spring, such as a leaf spring, or a coil spring and a hinge. In the foregoing embodiment, the resilient blocking element may include a roller allowing the blocking element to roll against an inside face of the sliding frame while the frame slides open. In the foregoing embodiment, the latch may form a unitary part with the mounting surface. The inventive subject matter further contemplates a kit including a latch and fasteners.

In another possible embodiment, the inventive subject matter is directed to a latch for a sliding door, the door having an inside and an outside face, including a mounting end for mounting the latch adjacent to the sliding door on a mounting surface over which the inside face of the sliding door would travel along a sliding path, a resilient blocking element having an end portion and a body portion coupled to the mounting end, and a stop element positioned to engage the first end of the resilient blocking element. The body portion of the resilient blocking element may be positioned at an angle relative to the mounting surface so that the end portion of the resilient blocking element engages the stop element, and the resilient blocking element and stop element are adapted to prevent the sliding door from opening when the door is in a closed position. The resilient blocking element may be movable from a door blocking position to a position between the mounting surface and the inside face of the sliding door so that a user can press the resilient blocking element into the space between the sliding door and the mounting surface and the resilient blocking element riding against the inside face of the sliding door when the door slides open over the mounting surface and travels along the sliding door path. The resilient blocking element may automatically return to the door blocking position when the door closes.

The inventive subject matter further contemplates a method for making a latch for a sliding frame by providing a mounting end for mounting the latch on a mounting surface over which a sliding frame would travel along a sliding path, providing a resilient blocking element having an end portion and body portion coupled to the mounting end, positioning a stop element to engage the first end of the resilient blocking element and adapted to prevent the sliding frame from opening when the frame is in a closed position, and configuring the resilient blocking element in a position that allows a user to disengage the latch by removing the resilient blocking element from the sliding path so that the sliding frame can be moved to an open position. In any of the foregoing embodiments, the body portion of the resilient blocking element may space the mounting end from the end portion with a length that allows for receiving at least a hand of a user.

These and other embodiments are described in more detail in the following detailed descriptions and the figures.

The foregoing is not intended to be an exhaustive list of embodiments and features of the inventive subject matter. Persons skilled in the art are capable of appreciating other embodiments and features from the following detailed description in conjunction with the drawings.

BRIEF DESCRIPTION OF THE DRAWINGS

The following figures show embodiments according to the inventive subject matter, unless noted as showing prior art.

DETAILED DESCRIPTION

Figure 1:
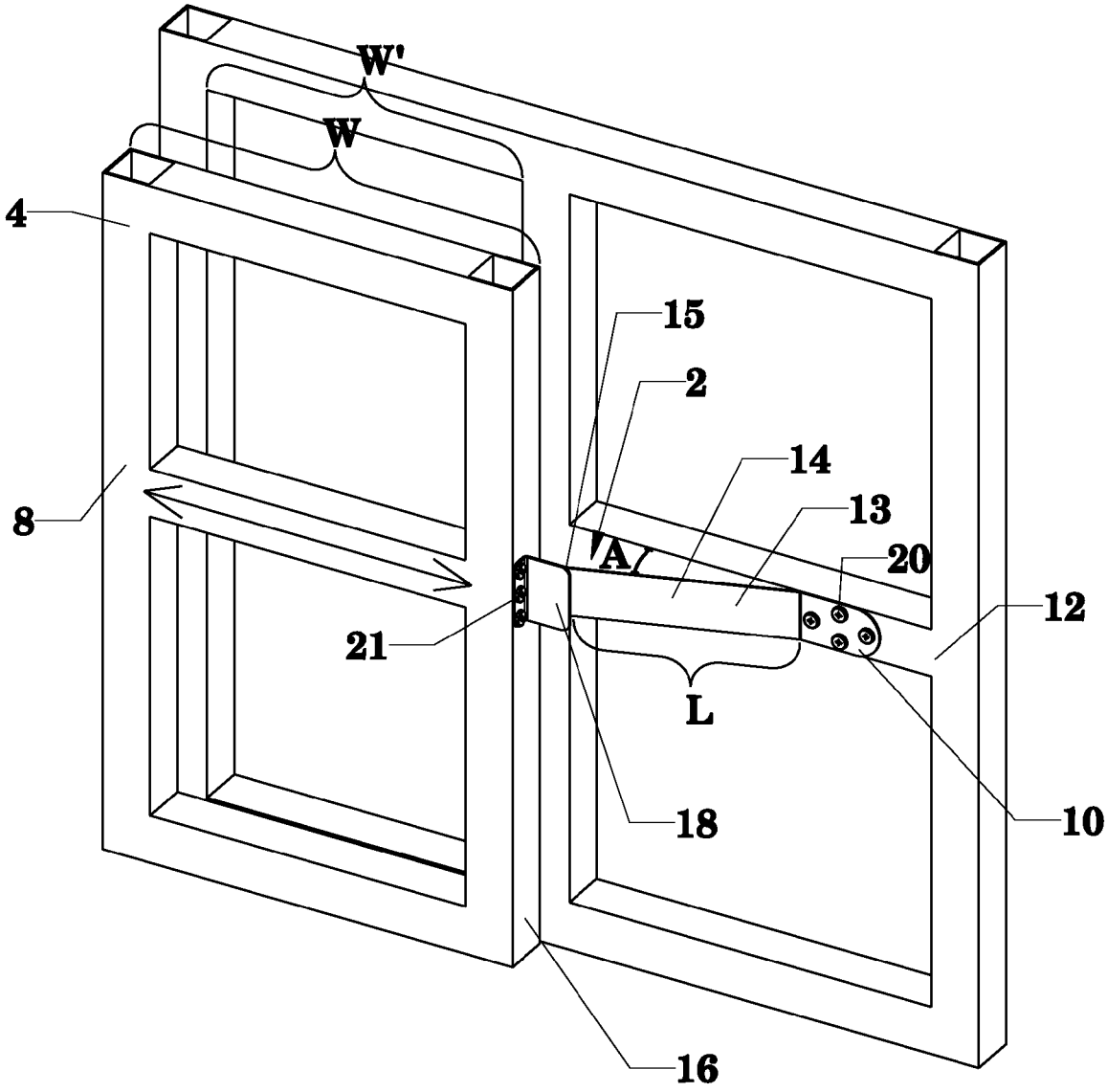
FIG. 1 shows a perspective view of a sliding door provided with a latch.
Figure 2:
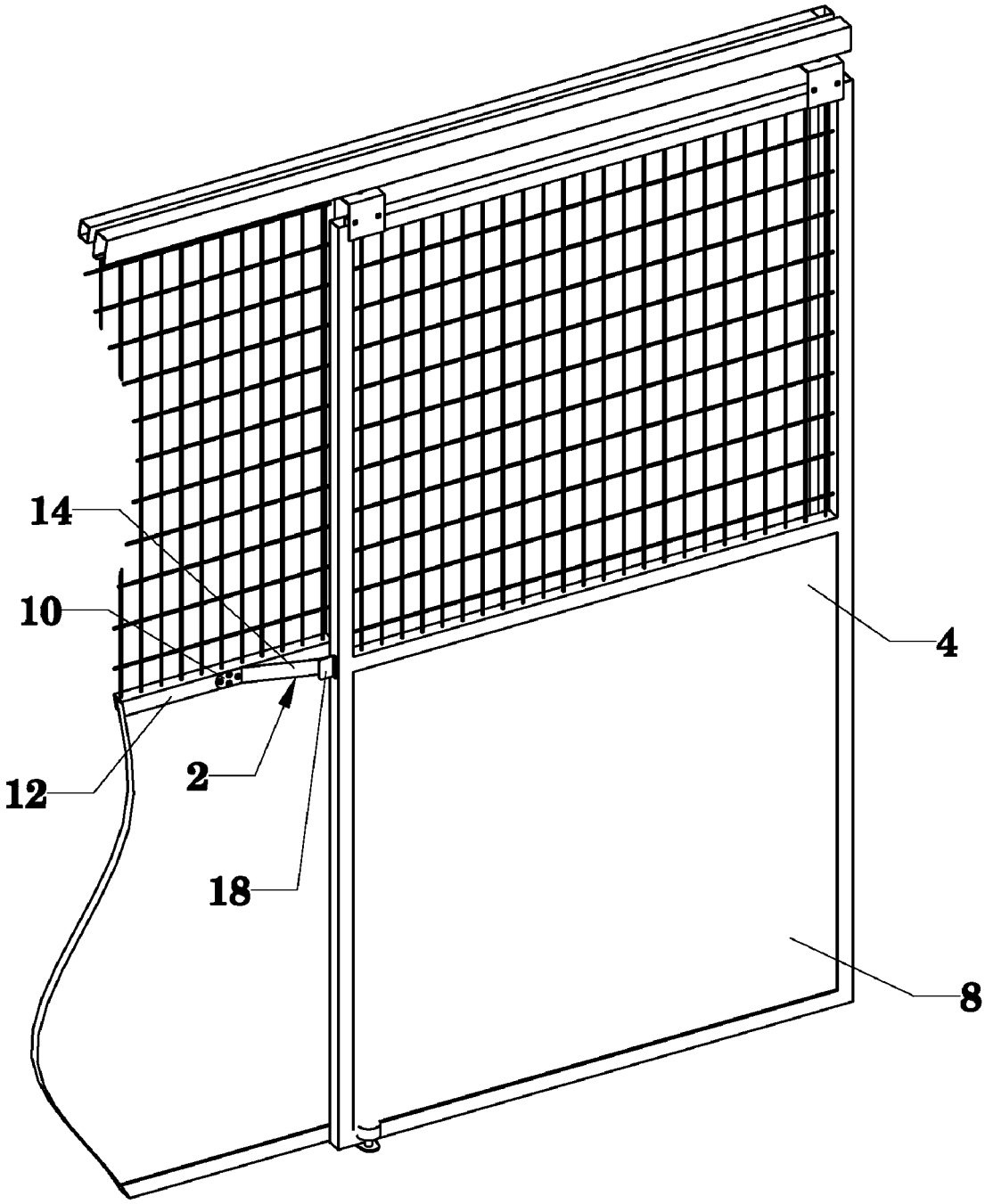
FIG. 2 shows a front view of a sliding barn door provided with a latch.
Figure 3:
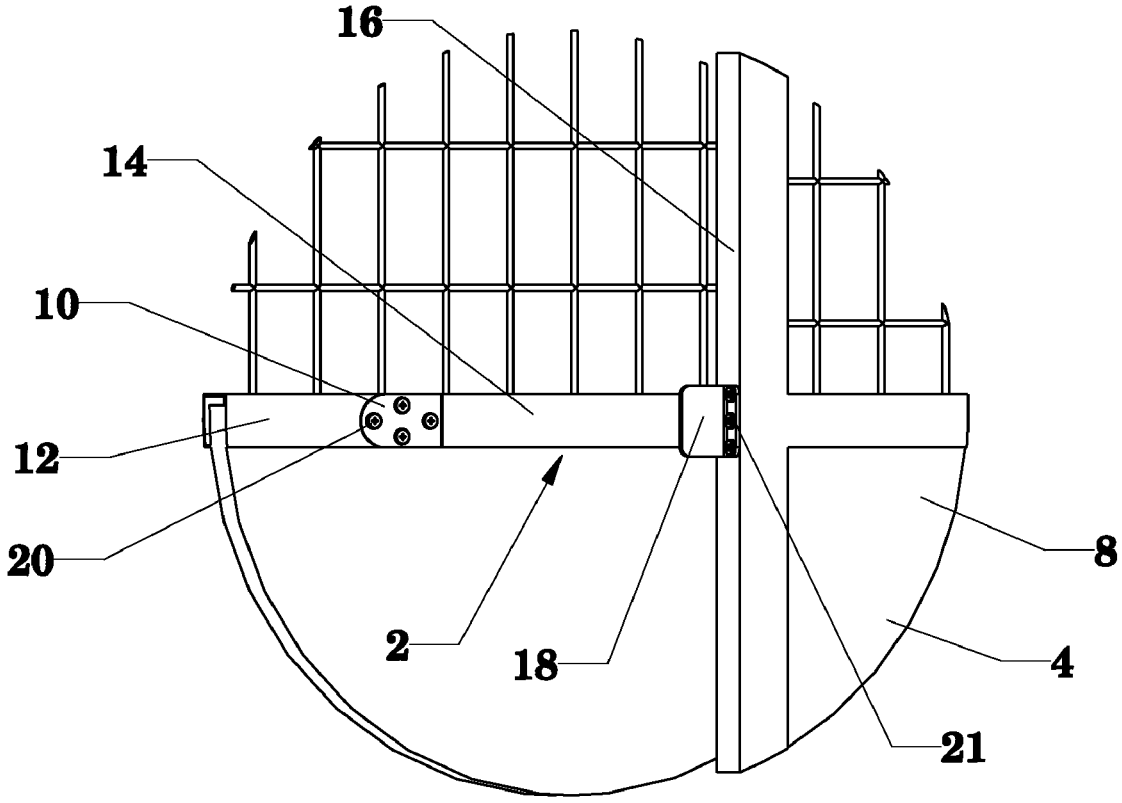
FIG. 3 shows a front view of the latch of the sliding barn door of FIG. 2.

Representative embodiments according to the inventive subject matter are shown in FIGS. 1-14, wherein the same or generally similar features share common reference numerals.

The inventive subject matter is generally directed to a novel latch for locking a frame or door which opens by sliding in one plane across an adjacent surface in a parallel plane. In some embodiments, the adjacent surface may be a surface of a fixed structure, such as a wall or a windowpane. In other embodiments, the adjacent surface may be a surface of a structure that is movable relative to the frame, such as a sliding door. In this context "frame" may refer to any sliding structure, such as a door, as well as to any kind of sliding window frame. The width of the sliding frame is at least as wide as the width of the opening that is covered by the sliding frame. For example, as shown in FIG. 1, a sliding frame with a width W covers an opening with width W'. The frame may be either mounted on or suspended from a track that slides across the opening. These frames are typically found on barn stalls, closets, windows, or pocket doors, for example.

A latch according to the inventive subject matter may have a mounting end, a resilient blocking element, and a stop element. In one possible embodiment, the mounting end mounts the latch on a mounting surface over which a sliding frame travels when opened along a sliding path. The resilient blocking element has an end portion and a body portion coupled to the mounting end. The stop element engages the end portion of the resilient blocking element and is adapted to prevent the sliding frame from opening when the frame is in a closed position. The resilient blocking element allows a user to disengage the latch by removing the resilient blocking element from the sliding path so that the sliding frame can be moved to an open position. The body portion of the resilient blocking element spaces the mounting end from the end portion and has a length that at least allows for receiving a hand of a user.

In some embodiments, the stop element may be a separate element mounted on a surface of the sliding frame or mounted on the mounting surface. In other embodiments, the stop element may be integrated with the resilient blocking element to engage the sliding frame.

In one possible embodiment, the resilient blocking element abuts the sliding frame and is movable to a position between the mounting surface and a path followed by the frame when the frame slides open sideways. A user can press the resilient blocking element into the space between the sliding path and the mounting surface to allow the frame to slide open. The resilient blocking element will then ride against the inside face of the frame. When the frame is pushed back into its closed position, the resilient element of the latch will spring back into the latching position.

In another possible embodiment, the latch is mounted on a sliding frame and a stop element is positioned on a mounting surface adjacent the sliding frame. The resilient blocking element of the latch is adapted to interact with the stop element to prevent the frame from sliding open. In this embodiment, the resilient blocking element can be pulled away from the stop element by a user thereby allowing the frame to slide sideways and follow a sliding path over the stop element to an open position. When the frame is pushed back into its closed position, the resilient blocking element will slide over the stop element and return to the latching position.

FIGS. 1-6 demonstrate the general operation of the inventive subject matter as it may be used for sliding stall doors. A sliding stall door is provided with a latch 2 positioned adjacent to sliding door 4. Sliding door 4 has an inside face 6 and outside face 8. The latch has a mounting end 10 for mounting the latch adjacent to sliding door 4 on a mounting surface 12, in a plane parallel to the inside face 6 of door 4 and over which the inside face 6 of sliding door 4 travels when the door slides open. The mounting end 10 may be attached to the mounting surface 12 by any suitable means of fastening, for example by screws 20. It could even be pre-molded or otherwise integrated into a frame, door, or portion of a door. A resilient blocking element 14 is attached to mounting end 10. Resilient blocking element 14 has a body portion 13 attached to the mounting end and a blocking end portion 15 that interacts with a stop element 18.

Figure 6:
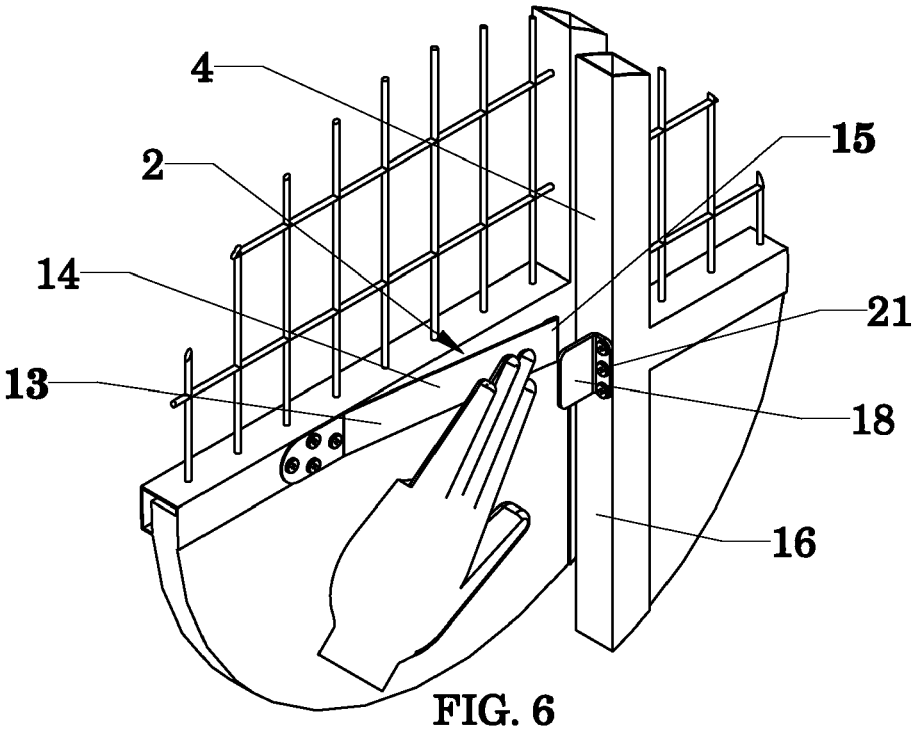
FIG. 6 shows the latch of FIG. 2 when pushed in an unlocking position.

As can be seen in FIG. 1 and FIGS. 4-6, for example, resilient blocking element 14 is movable to a position between mounting surface 12 and inside face 6 of sliding door 4. FIG. 6 illustrates how a user can easily disengage the latch by pushing on the body portion 13 of resilient blocking element 14 thereby moving blocking end portion 15 into the space between sliding door 4 and mounting surface 12. Subsequently, sliding door 4 is free to slide open along a sliding door path over resilient blocking end 14 and mounting surface 12 to an open position. While sliding door 4 slides open along its path, resilient blocking end 14 will ride against inside face 6 of door 4. Body 13 of resilient blocking element 14 has a length L that is at least long enough to receive a hand of a user. The length L of body 13 allows for a hand to push the resilient blocking element away from stop element 18.

Figure 4:
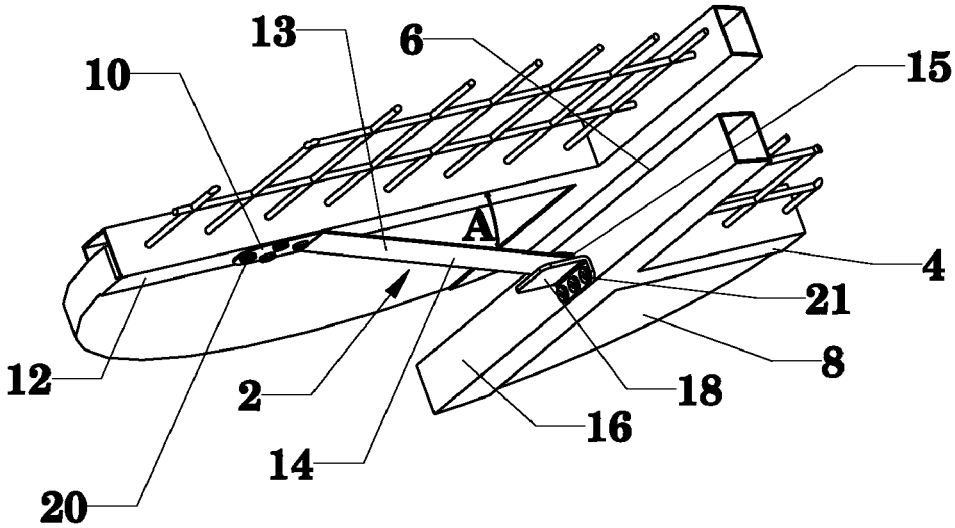
FIG. 4 shows a top view of the latch of FIG. 2.
Figure 5:
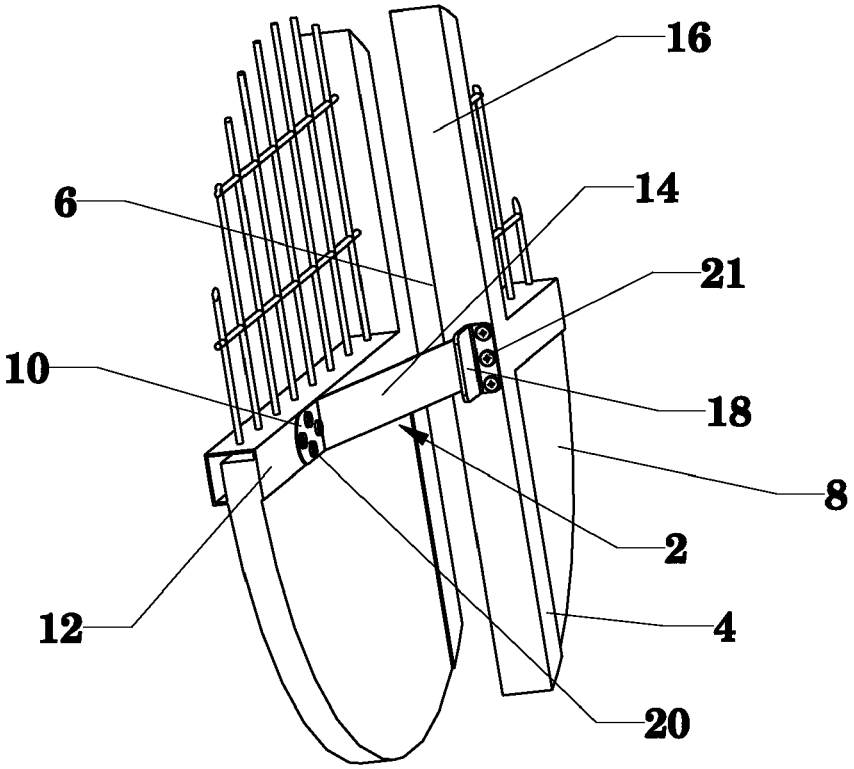
FIG. 5 shows a side view of the latch of FIG. 2.
Figure 10A:
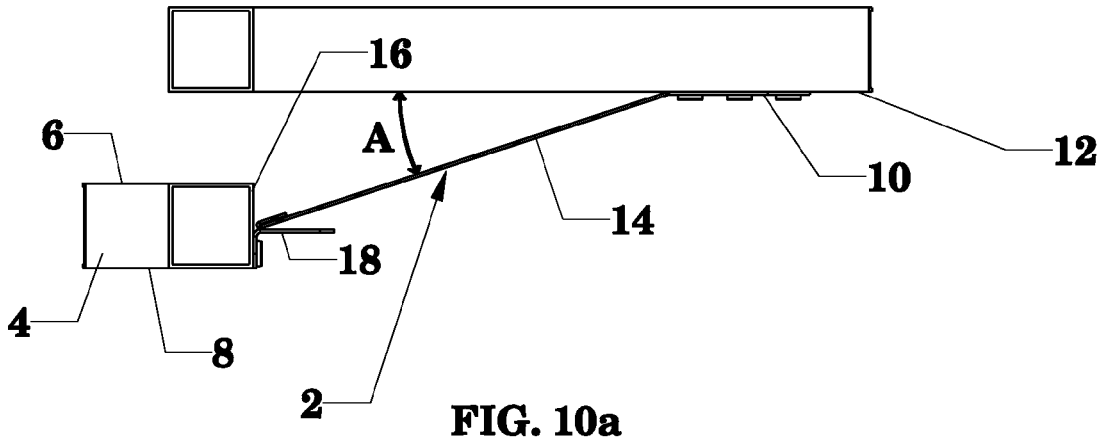
FIG. 10*a* shows a top view of a latch in the closed position.
Figure 10B:
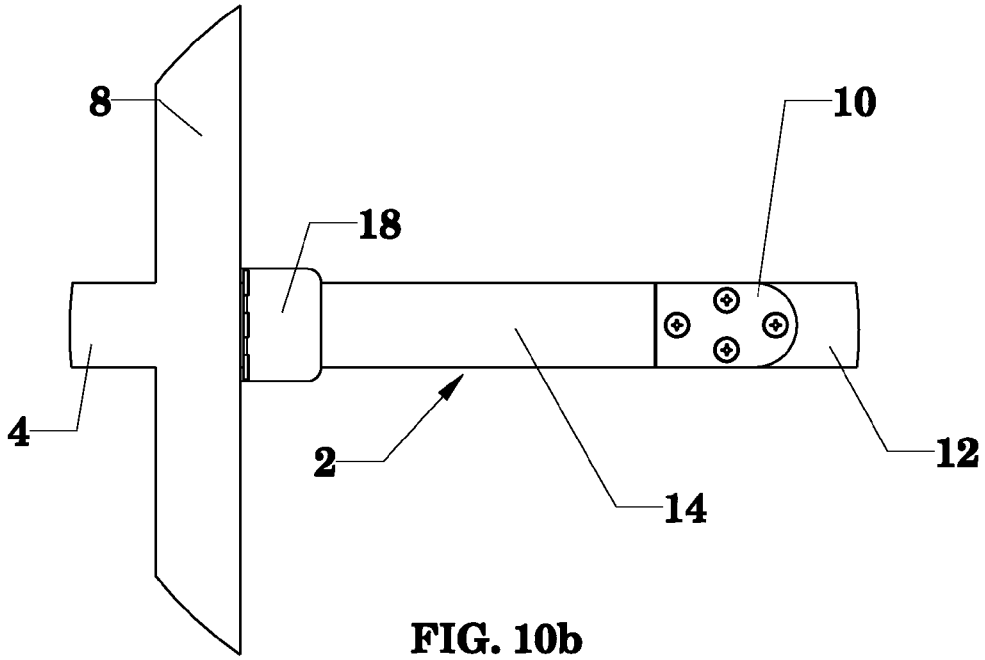
FIG. 10*b* shows a front view of a latch in the closed position.

FIGS. 1, 4, and 10*a* illustrate how resilient blocking end 14 is positioned at an angle A relative to mounting surface 12. This allows resilient blocking end 14 to cover the space between mounting surface 12 and side surface 16 of sliding door 4 such that resilient blocking end 14 abuts side surface 16 of sliding door 4 and prevents sliding door 4 from being pushed open along its sliding path. The dimensions of the resilient blocking end and its angle relative to the mounting surface may vary depending on the dimensions of the door and the spacing available between sliding door and mounting surface. In some embodiments, resilient blocking end 14 may be adjustable, for example by bending the blocking element slightly to abut the side surface of the sliding door.

Figure 8:
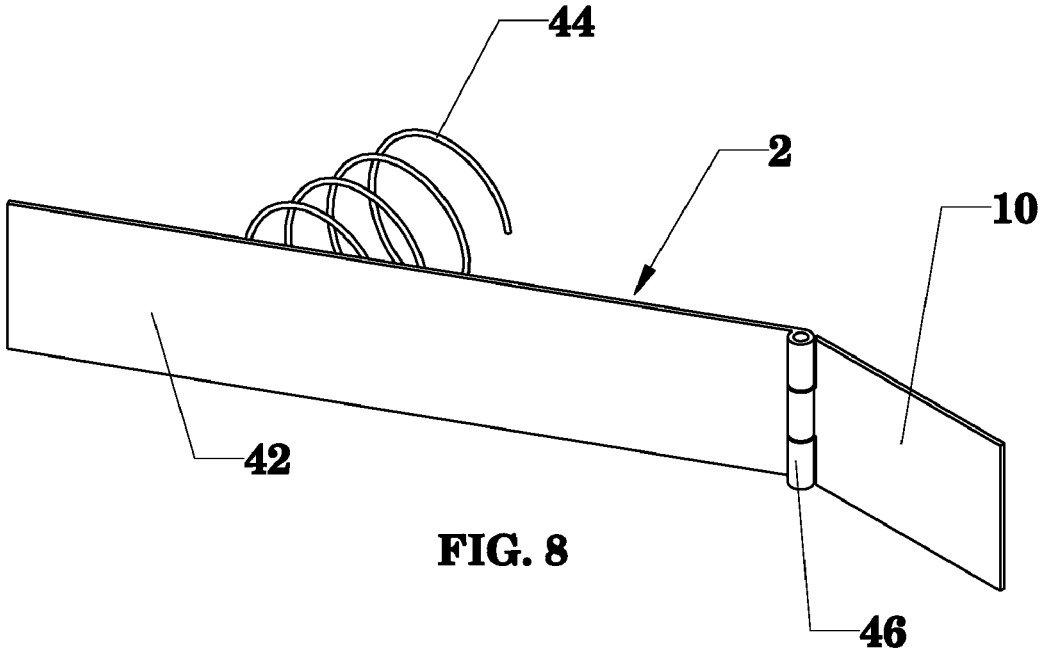
FIG. 8 shows a perspective view of another embodiment of a latch.

When the sliding door returns to the closed position, resilient blocking element 14 may automatically return to the door blocking position, for example, by springing back into its door blocking position because of the specific resilience of the material of the resilient blocking element. The resilient blocking element may exhibit a degree of stiffness in the direction of the sliding path that allows the resilient blocking element to block the sliding door, while showing flexibility in a direction perpendicular to the sliding path thereby allowing the blocking element being pushed or pulled out of the sliding path. The resilience of the blocking element also allows the blocking element to spring back automatically to its original position after the door is closed. In one possible embodiment, the resilient qualities of the blocking element may be provided by an elastic material, such as a resilient blocking element 14 in the form of a leaf spring, as shown in FIGS. 1-6. In other possible embodiments, these qualities may be provided by a combination of structural elements, for example, as shown in FIG. 8, where a resilient blocking element 14 is formed by an elongated element 42 coupled to a coil spring 44 and a hinge 46. Other possible embodiments may have a combination of materials and structures to provide for the desired features.

FIGS. 1-6 and 10*a* and 10*b* illustrate how a stop element 18 engages resilient blocking element 14. Stop element 18 is a separate piece of hardware attachable to a side surface 16 of door 4. Stop element 18 assists in preventing the sliding door from opening by preventing resilient blocking element 14 from moving away from the mounting surface beyond working angle A formed between mounting surface 12 and blocking element 14. Stop element 18 may be attached to side surface 16 by any suitable fastening means, such as screws 21.

Figure 9:
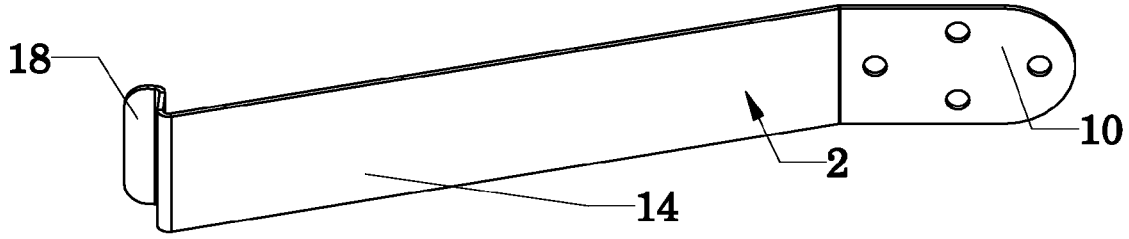
FIG. 9 shows a perspective view of another embodiment of a latch.

In another possible embodiment, illustrated in FIG. 9, stop element 18 may be incorporated with resilient blocking element 14 to form a unitary piece. Stop element 18 is positioned at the end of resilient blocking element 14 that interacts with the side surface of a sliding door. Stop element 18 may abut the side surface of a sliding door and prevent the sliding door from moving between resilient blocking element 14 and the surface on which latch 2 may be mounted. Here, stop element 18 has an L-shape acting as a hook that holds resilient blocking element 14 in position. To open the sliding door, resilient blocking element 14 may be pushed in the spacing between the sliding door and the mounting surface, in a manner similar as described above.

As can be seen on FIGS. 1-6, latch 2 is mounted on a mounting surface 12 adjacent to door 4 at a side opposite to the side where the door opens. At this position, the latch will not interfere with an animal leaving or entering the stall and thus reduces the risk of injury. Mounting a latch at this location minimizes catch points that can injure a horse or other livestock.

Figure 7:
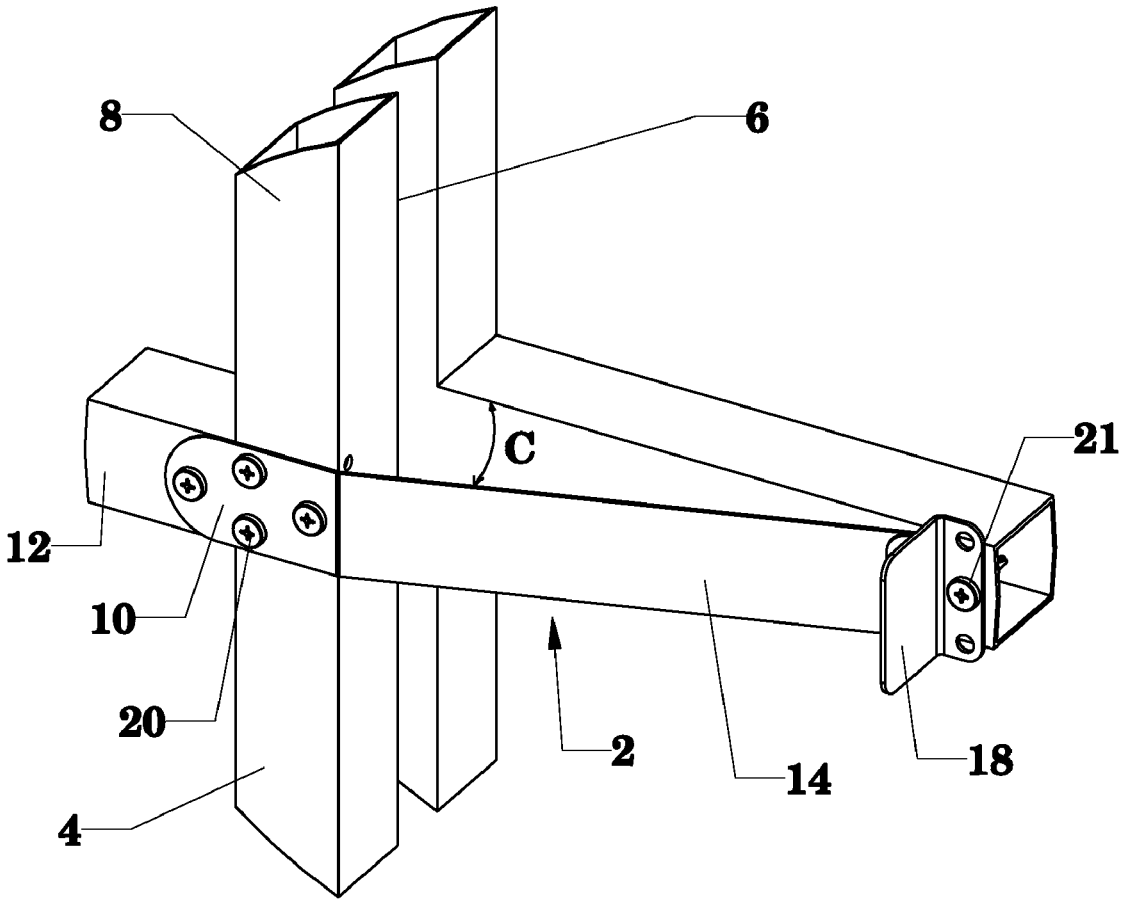
FIG. 7 shows a perspective view of another embodiment of a latch.

FIG. 7 illustrates an alternative embodiment, wherein resilient blocking element 14 may be pulled away from stop element 18 to allow door 4 to slide open. In this case, latch 2 is inverted, i.e., mounting end 10 is mounted on sliding door 4 and stop element 18 is positioned on mounting surface 12 adjacent to sliding door 4 such that resilient blocking element 14 abuts stop element 18. Resilient blocking element 14 is positioned at an angle C relative to the mounting surface 12. Mounting end 10 and stop element 18 may be attached to their respective mounting surfaces by screws 20 and 21, for example. The dimensions of stop element 18 are such that the stop element does not interfere with the sliding path of door 4, i.e., the dimensions of stop element 18 remain within the space between mounting surface 12 and inside face 6 of sliding door 4. When resilient element 14 is pulled over stop element 18, door 4 can be pushed sideways and follow its path over stop element 18. When door 4 is pushed back to its closed position, resilient blocking element 14 will be pushed over stop element 18 and return to its blocking position.

FIGS. 11-14 illustrate how a latch according to the inventive subject matter may be adjusted to provide for a locking mechanism for a dual sliding door, such as closet doors. Latch 22 may be mounted adjacent to a first sliding door 24, on a mounting surface 26 that is formed by a second sliding door 28. Latch 22 has a resilient blocking element 30 attached to a mounting end 32. Resilient blocking element 30 is positioned at an angle B relative to mounting surface 26 to cover the space between inside face 34 of sliding door 24 and mounting surface 26 so that resilient blocking element 30 abuts side surface 36 of door 24. For example, closet doors may have a clearance of about one inch between the inside face of the first sliding door and the outside face of the second sliding door. This leaves enough room to accommodate a latch. Angle B may vary, for example, depending on the material used to form the blocking element of the latch or the scale of the latch.

Figure 13:
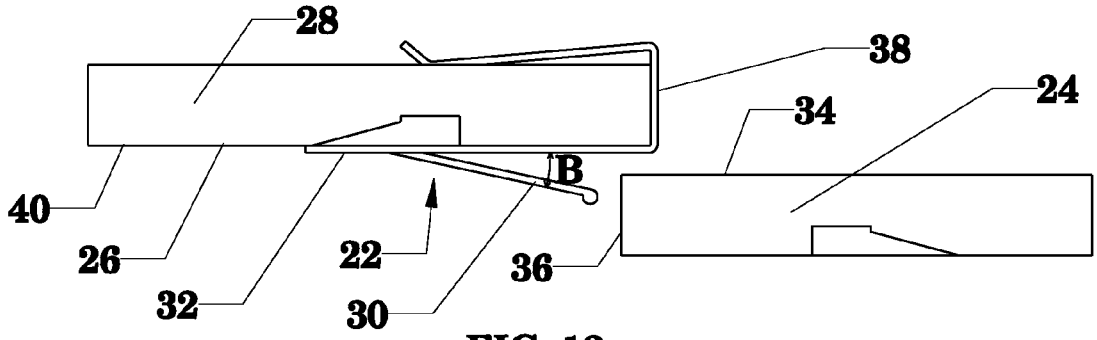
FIG. 13 shows a top view of the latch of FIG. 11.

As can be seen in FIG. 13, latch 22 may be mounted on first sliding door 24 by coupling mounting end 32 to mounting element 38. Mounting element 38 provides a tensioned fit to the latch over the side of second sliding door 28. Mounting element 38 may be integrated with latch 22 as one piece that conveniently attaches to the side of a sliding door. Here, mounting element 38 takes the form of a U-shaped snap that attaches latch 22 to door 28. However, any other suitable means of mounting or fastening the latch to the sliding door may be used, for example by clamping.

Figure 11:
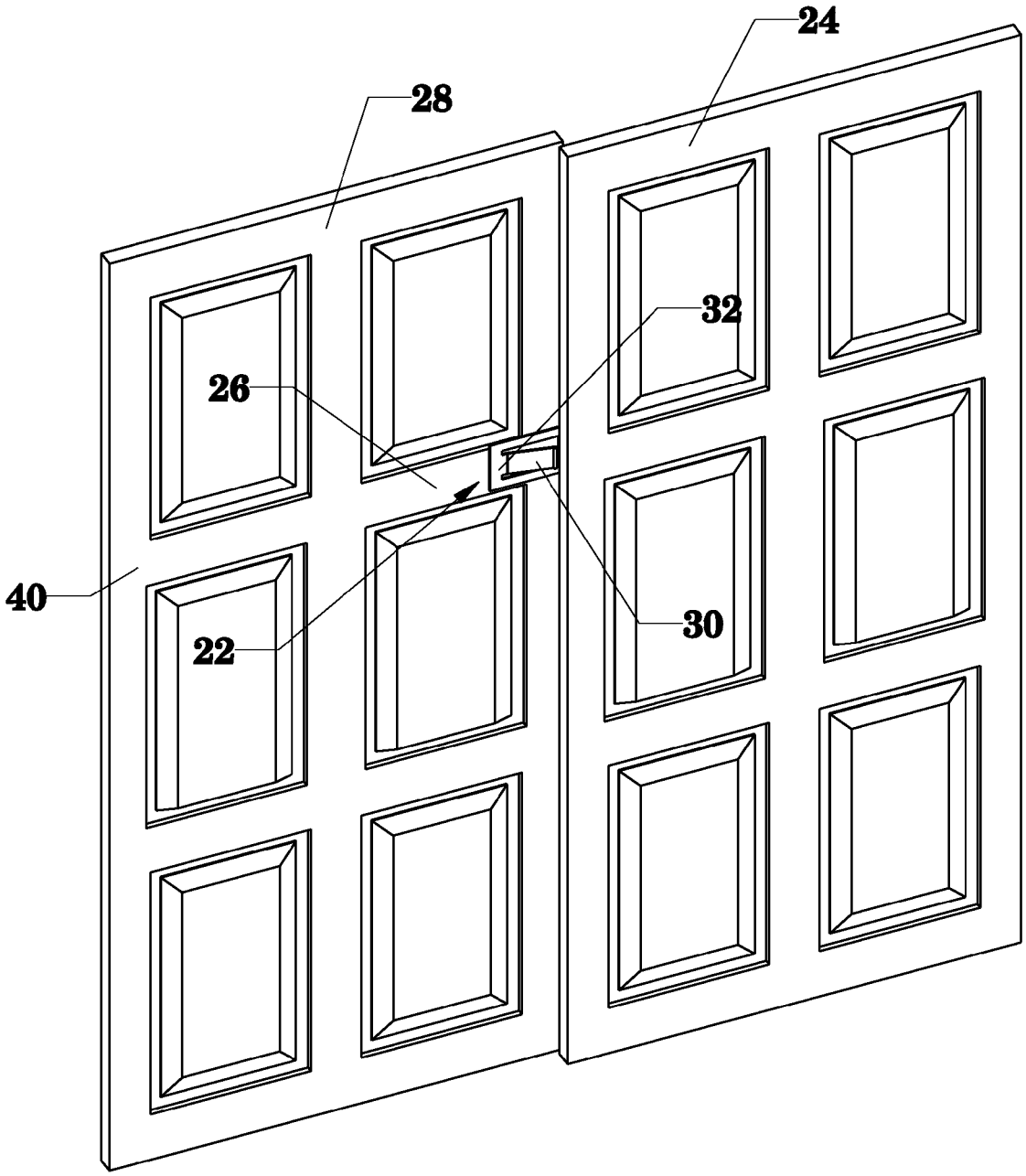
FIG. 11 shows a perspective view of a sliding closet door provided with a latch in the closed position.
Figure 12:
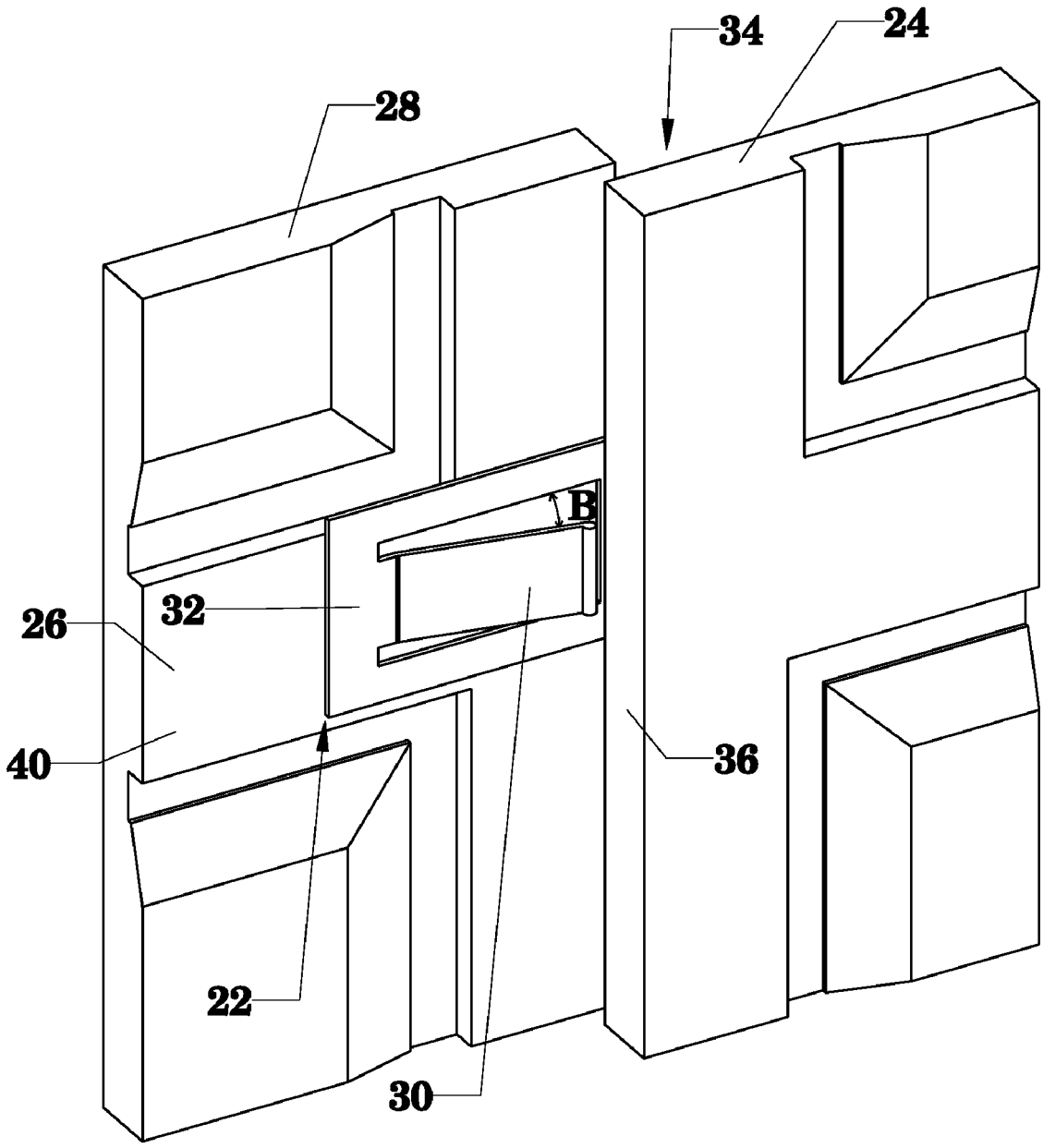
FIG. 12 shows a perspective view of the latch of FIG. 11.
Figure 14:
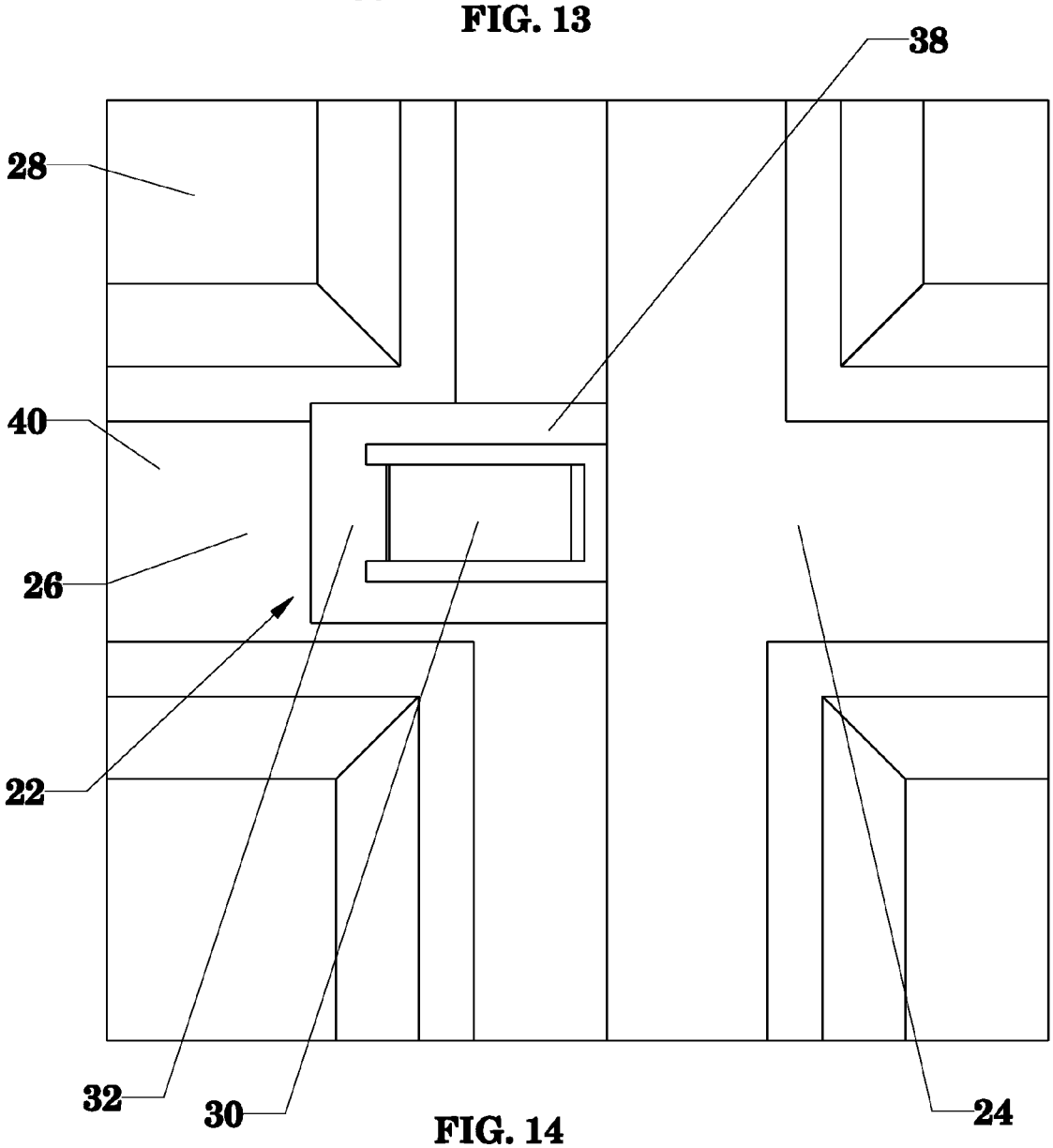
FIG. 14 shows a front view of the latch of FIG. 11.

Latch 22 may be positioned, for example, on the upper half of sliding door 28 at a height out of reach of small children, thereby providing safety advantages. As can be seen in FIGS. 11, 12 and 14 the latch may be positioned on the door in any area where operation of the latch is not hindered by door features, such as decorative recesses or moldings. When a latch is mounted on a second sliding door, the latch provides an additional advantage that neither one of the sliding doors will open until the blocking element is pushed in the space in between the inside face 34 of door 24 and outside face 40 of door 28.

In another possible embodiment, the latch may have a resilient blocking element provided with a roller. The roller may be attached to the resilient blocking element of the latch where it will allow the blocking end to roll against the inside face of the sliding door while the door is sliding open. The roller prevents damage to the inside face of the sliding door by the resilient blocking element pushing against the door and potentially scratching the door surface.

It is understood that sliding frames may be provided with several latches depending on the specific needs.

The inventive subject matter further contemplates a method for making and using such a latch. A latch for a sliding frame, for example, a sliding door as discussed above, can be formed by providing mounting end 10 for mounting latch 2 on mounting surface 12 over which sliding door 4 would travel along a sliding path, and coupling body portion 13 of resilient blocking element 14 to mounting end 10. Stop element 18 is positioned to engage end portion 15 of resilient blocking element 14 so that the latch prevents sliding door 4 from opening when door 4 is in a closed position. Resilient blocking element 14 is configured in a position that allows a user to disengage latch 2 by removing resilient blocking element 14 from the sliding path so that sliding door 4 can be moved to an open position.

The latch may be formed as a multi-piece or one-piece structure. The latch may be manufactured of any suitable material, for example of sheet metal or by injection molding of plastics.

Persons skilled in the art will recognize that many modifications and variations are possible in the details, materials, and arrangements of the parts and actions which have been described and illustrated in order to explain the nature of the inventive subject matter, and that such modifications and variations do not depart from the spirit and scope of the teachings and claims contained therein.

Any patent and non-patent literature cited herein is hereby incorporated by references in its entirety for all purposes.

The invention claimed is:

1. A latch assembly for a sliding frame, comprising a latch and a stop element, the latch comprising a mounting end for mounting the latch on a mounting surface adjacent and substantially parallel to the sliding frame and the mounting end dimensioned to allow the sliding frame to slide along a sliding path over the mounting end when the latch allows the sliding frame to move from a closed position to an open position;

a blocking element having an end portion and a body portion coupled to the mounting end, the body portion extending from the mounting end at an angle relative to a plane of the mounting surface and the body portion having a length that allows the blocking element to be manipulated by a user and the body portion dimensioned such that the body portion extends to cover a space between the mounting surface and a side surface of the sliding frame and the end portion of the blocking element abutting the side surface of the sliding frame to prevent the frame from sliding into an open position;

the stop element mounted on the side surface of the sliding frame such that the end portion of the blocking element engages the stop element and prevents the sliding frame from opening when the frame is in the closed position; and the blocking element having a degree of stiffness in the direction of the sliding path that allows the blocking element to block the sliding frame, and having a degree of flexibility in a direction perpendicular to the sliding path to allow a user to disengage the latch by pushing the blocking element out of the sliding path so that the sliding frame can be moved to an open position.

2. The latch of claim 1, wherein the blocking element is moveable to a position between the mounting surface and the sliding path so that the user can disengage the latch by pressing the blocking element into the space between the mounting surface and the sliding path.

3. The latch of claim 1, further comprising a mounting element coupled to the mounting end, and adapted to couple the mounting end to the mounting surface.

4. The latch of claim 3, wherein the mounting element provides for a tensioned fit to the mounting surface.

5. The latch of claim 1, wherein the blocking element comprises a spring.

6. The latch of claim 5, wherein the blocking element comprises a leaf spring.

7. The latch of claim 1, wherein the latch forms a unitary part with the mounting surface.

8. The latch of claim 1, further comprising fasteners, in a kit with the latch.

9. A method for making a latch assembly for a sliding frame, comprising: providing a latch and a stop element; providing a mounting end for mounting the latch on a mounting surface adjacent and substantially parallel to the sliding frame and the mounting end dimensioned to allow the sliding frame to slide along a sliding path over the mounting end when the latch allows the sliding frame to move from a closed position to an open position;

providing a blocking element having an end portion and a body portion and coupling the body portion to the mounting end, the body portion extending from the mounting end at an angle relative to a plane of the mounting surface, the body portion having a length that allows the blocking element to be manipulated by a user and the body portion dimensioned such that the body portion extends to cover a space between the mounting surface and a side surface of the sliding frame, the end portion of the blocking element abutting the side surface of the sliding frame to prevent the frame from sliding into an open position, and the blocking element having a degree of stiffness in the direction of the sliding path that allows the blocking element to block the sliding frame and a degree of flexibility in a direction perpendicular to the sliding path;

mounting the stop element on the side surface of the sliding frame such that the end portion of the blocking element engages the stop element and prevents the sliding frame from opening when the frame is in the closed position; and configuring the blocking element in a position that allows a user to disengage the latch by removing the blocking element from the sliding path so that the sliding frame can be moved to an open position.

10. The method of claim 9, wherein the body portion of the blocking element spaces the mounting end from the end portion with a length that allows for receiving at least a hand of the user.

11. A locking mechanism for a dual sliding door, comprising:

a mounting end for mounting the mechanism on a mounting surface of a first sliding door over which a second sliding door travels along a sliding path when the mechanism allows the second sliding door to move from a closed position to an open position;

a blocking element having and end portion and a body portion, the body portion coupled to the mounting end and extending from the mounting end at an angle relative to a plane of the mounting surface such that the end portion of the blocking element abuts a side surface of the second sliding door when the mechanism is in the closed position; and wherein the blocking element is dimensioned to allow a user's hand to push the blocking element towards the mounting surface such that the end portion of the blocking element is removed from the side surface of the second sliding door and a user can slide the second sliding door along the sliding path over the mounting end of the locking mechanism.

12. The locking mechanism of claim 11, further comprising a mounting element coupled to the mounting end, and adapted to couple the mounting end to the mounting surface.

13. The locking mechanism of claim 12, wherein the mounting element provides for a tensioned fit of the mechanism to the mounting surface.

14. The locking mechanism of claim 11, wherein the end portion of the blocking element is adapted to ride against an inside face of the second sliding door when the second sliding door slides open over the mounting surface.

15. The locking mechanism of claim 11, wherein the end portion of the blocking element automatically returns to the door blocking position when the second sliding door slides into the closed position.

* * * * *